US007364690B2

(12) United States Patent
Paret et al.

(10) Patent No.: US 7,364,690 B2
(45) Date of Patent: Apr. 29, 2008

(54) DEVICE FOR INJECTING A TREATMENT GAS INTO A MOLTEN METAL

(75) Inventors: Robert Paret, Voiron (FR); Daniel Coudry, St. Ismier (FR)

(73) Assignee: Pechiney Rhenalu, Paris (FR)

( * ) Notice: Subject to any disclaimer, the term of this patent is extended or adjusted under 35 U.S.C. 154(b) by 276 days.

(21) Appl. No.: 10/524,119

(22) PCT Filed: Aug. 27, 2003

(86) PCT No.: PCT/FR03/02591

§ 371 (c)(1),
(2), (4) Date: Feb. 10, 2005

(87) PCT Pub. No.: WO2004/020679

PCT Pub. Date: Mar. 11, 2004

(65) Prior Publication Data

US 2005/0253315 A1 Nov. 17, 2005

(30) Foreign Application Priority Data

Aug. 28, 2002 (FR) ..... 02 10675

(51) Int. Cl.
*C21B 7/16* (2006.01)

(52) U.S. Cl. ..... 266/135; 266/268; 266/269

(58) Field of Classification Search ..... 266/268, 266/135, 269
See application file for complete search history.

(56) References Cited

U.S. PATENT DOCUMENTS

| | | | | | |
|---|---|---|---|---|---|
| 570,129 | A | * | 10/1896 | Hartman | 266/135 |
| 1,034,995 | A | * | 8/1912 | Gannon | 266/269 |
| 2,261,559 | A | * | 11/1941 | Osborn | 266/268 |
| 2,922,175 | A | * | 1/1960 | De Villiers et al. | 266/269 |
| 4,114,865 | A | * | 9/1978 | McKerrow et al. | 266/269 |
| 4,353,530 | A | * | 10/1982 | Iyama et al. | 266/135 |
| 5,667,687 | A | | 9/1997 | Lange | |
| 5,846,479 | A | | 12/1998 | English | |

FOREIGN PATENT DOCUMENTS

DE 29904385 9/1999

* cited by examiner

*Primary Examiner*—Scott Kastler
(74) *Attorney, Agent, or Firm*—Dennison, Schultz & Macdonald

(57) ABSTRACT

The invention relates to a device (8) which is used to inject a treatment gas into a molten metal contained in a tank (1) and which is designed to be fixed in one of the walls of said tank. The inventive device comprises at least one injection nozzle (18) which is equipped with an end hole (19). Said device is characterised in that it comprises a mobile means (14) which can be manoeuvred from outside of the injection device and which is used to unblock the aforementioned end hole of the nozzle.

12 Claims, 2 Drawing Sheets

DEVICE FOR INJECTING A TREATMENT GAS INTO A MOLTEN METAL

This application is a filing under 35 USC 371 of PCT/FR2003/002591, filed Aug. 27, 2003.

BACKGROUND OF THE INVENTION

This invention relates firstly to a device for injecting a treatment gas into a molten metal contained in a tank, and secondly a tank used in metallurgy and comprising at least one such injection device.

It is known how to treat a molten metal flow before casting it in the form of a metallurgical product, the molten metal possibly consisting particularly of aluminium, an aluminium alloy, magnesium or a magnesium alloy. The molten metal treatment is generally aimed at eliminating dissolved gases, particularly hydrogen, and also dissolved impurities such as alkaline metals, and solid or liquid inclusions that could reduce the quality of cast products.

Conventionally, this treatment step is done by injecting a treatment gas within the molten metal contained in a tank. The treatment gas may consist of an inert gas insoluble in the molten metal such as argon, or a reactive gas such as chlorine, or a mix of these gases.

The inert and insoluble gas absorbs the dissolved gas by a dilution effect and transports it with it. The reactive gas reacts with some dissolved impurities and thus generates liquid or solid inclusions that, like those already present in the molten metal, can be eliminated by a filtration operation.

U.S. Pat. No. 5,846,479 describes an in line treatment tank for a molten metal flow comprising several nozzles fixed in one wall of the tank. Part of each nozzle is located outside the tank and another part of the nozzle comprises an end hole housed inside the tank. However, this end hole has a very small diameter that can get blocked by the molten metal and metal oxides.

This hole can be cleaned after stopping the installation and opening the tank, from inside the tank. However, this is a laborious operation that causes loss of time and interrupts the treatment process.

SUMMARY OF THE INVENTION

The purpose of the invention is to provide a device for removing obstruction in the hole of each nozzle during operation of the installation.

Consequently, the invention relates to a device for injection of a treatment gas into a molten metal contained in a tank, the said device being designed to be fixed in one of the tank walls and comprising at least one injection nozzle provided with an end hole, characterized in that it comprises a mobile means that can be manoeuvred from outside the injection device and that can unblock the said nozzle end hole.

Thus, regardless of whether the treatment gas used is an inert gas or a reactive gas, it is then possible to continue the molten metal treatment process without deteriorating the treatment quality by perforating and/or pushing through the deposits blocking the end hole of the nozzle using mobile means manoeuvred from outside the tank.

The said mobile means is advantageously capable of passing through the end hole, which makes it easy to remove the obstruction from this hole.

According to one preferred embodiment, the mobile means comprises a rod installed free to slide inside the nozzle, the said rod being capable of passing from a rest position in which it is set back from the end hole of the nozzle so as to enable passage of the treatment gas, to an advanced position in which it may unblock the end hole.

According to a first variant embodiment, the rod comprises an upstream part that is firstly capable of passing through one end of the nozzle opposite the end hole, while maintaining leak tightness, and secondly is equipped with a manual control device. This manual control device advantageously comprises a handle.

Advantageously, the device comprises an elastic element, typically a spring, which holds the rod in the rest position.

According to a second variant embodiment, an automated control device is attached to the rod. This control device may for example be made using an operating element acting on the sliding of the rod, such as a pneumatic, electric or electromechanic element. These automated devices may be controlled by an operator or a programmable system. If there are several injection devices, it is then advantageous to combine one or several operating elements, so as to make the different rods slide.

The nozzle preferably contains at least one rod guidance means. This may be composed of a ring presenting a central hole and peripheral holes. The rod then slides through the central hole of the ring and the injected gas passes through the peripheral holes.

Advantageously, the cross section or diameter of the rod decreases along the direction of the end hole of the nozzle.

This invention also relates to a molten metal treatment tank such as a treatment tank for a molten metal flow (called the "inline treatment tank"), characterised in that it comprises at least one gas injection device according to the invention. In the case in which such a tank comprises several injection devices, it is then advantageous to activate these devices with a time offset using an automated control device. For example, this can be done using a camshaft in which the cams are fixed at an angular offset.

The invention also relates to the use of the molten metal treatment tank defined above. The molten metal may be aluminium, an aluminium alloy, magnesium or a magnesium alloy.

BRIEF DESCRIPTION OF THE DRAWINGS

The invention will be better understood after reading the detailed description given below with reference to the attached figures.

DESCRIPTION OF THE PREFERRED EMBODIMENTS

Figure 1:
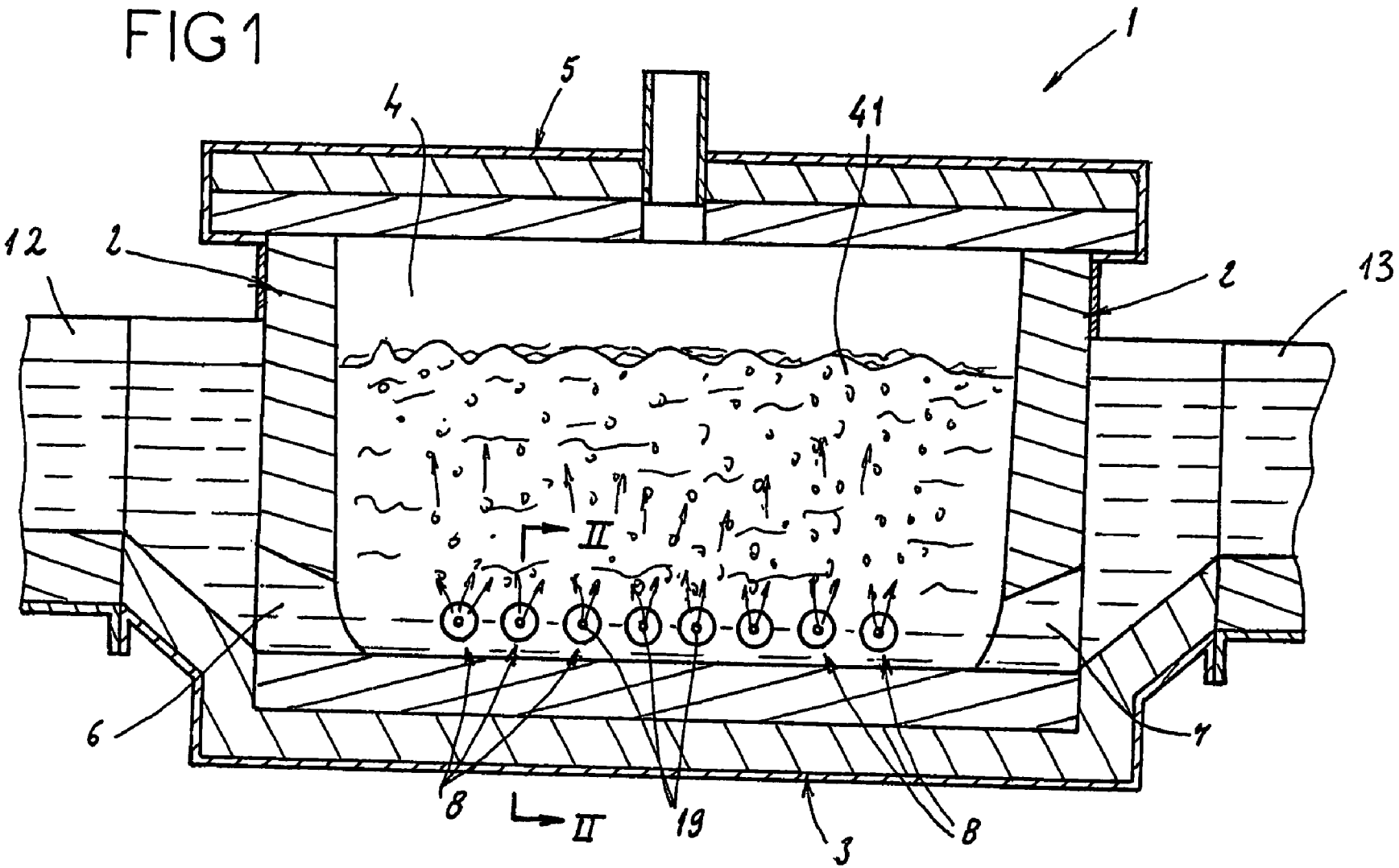
FIG. 1 is a cross sectional view of a tank comprising several injection devices according to the invention.

FIG. 1 shows a tank 1 according to an advantageous embodiment of the invention. This tank 1 comprises a sidewall 2 and a bottom 3 to define a treatment compartment 4, a cover 5, and molten metal inlet means 6 and outlet means 7, and devices 8 for injection of a treatment gas according to the invention.

The injection device 8, or each injection device 8 is typically fixed in the sidewall 2 of the tank 1 that is composed of an assembly of layers 9 to 11, the outer layer 9 being made from metal (and usually called the "box") and the other layers 10 and 11 being made from refractory materials. The function of the layer 10 that may be formed from several superposed layers, is usually to thermally insulate the tank. The layer 11 is more specifically designed to resist the molten metal.

Figure 2:
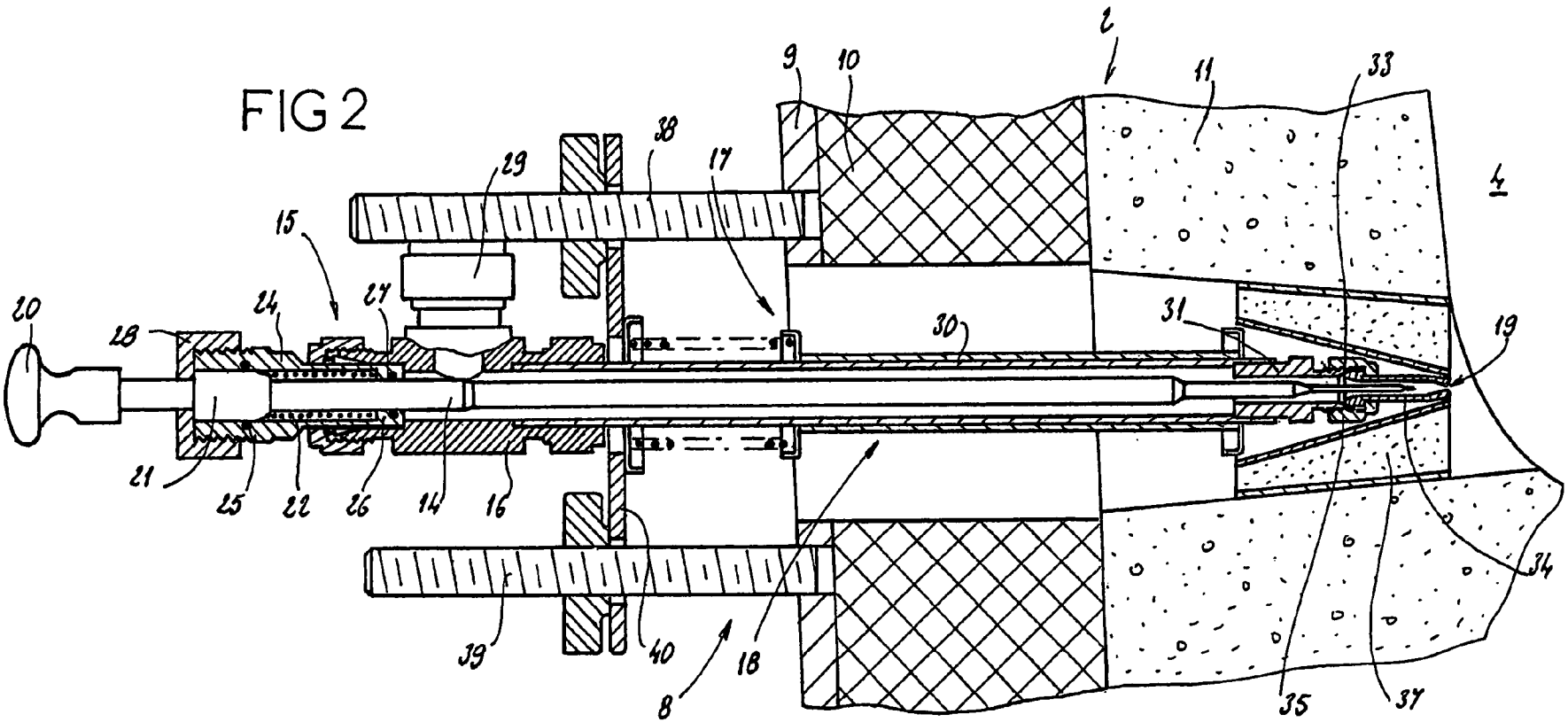
FIG. 2 shows a partial sectional view of the tank according to line II-II in FIG. 1.

FIG. 2 more specifically illustrates an advantageous embodiment of one of the injection devices 8.

In this embodiment, the injection device 8 comprises a metallic rod 14 capable of sliding in an approximately tubular housing, which can be used for inlet of treatment gas within the treatment compartment 4 of the tank 1.

More precisely, the injection device 8 is broken down firstly into an upstream part 15 located outside the tank 1, this upstream part 15 being fixed at one of its ends in a hollow connection element 16 that communicates freely with a treatment gas reservoir (not shown), and secondly a downstream part 17 comprising a nozzle 18 fixed in the connection element 16. The nozzle 18 has an end hole 19 located inside the treatment compartment 4 of the tank 1.

The rod 14 has a first end located outside the tank 1 and the injection device 8 to which a handle 20 is connected, and a second end housed in the tank 1. Apart from an annular shoulder 21 fixed to the rod 14 adjacent to its first end, the rod 14 has a diameter that typically decreases non-uniformly towards its second end. A spring 22 inserted through the second end of the rod 14 is placed around the rod and has a diameter slightly smaller than the diameter of the shoulder 21.

The upstream part 15 is made from an approximately tubular body 24 with an upstream end, a central channel and a downstream end. The diameter of the central channel at the upstream end is approximately equal to the diameter of the projection 21 from the rod 14. A first seal 25 is fixed in the body 24 and is designed to cooperate with the shoulder 21 when the rod 14 is inserted in the central channel. The central channel has an inner shoulder 26 at the downstream end, with a diameter equal to approximately the diameter of the rod 14. A second seal 27 is fixed in this shoulder 26. The sealing means 25, 27 are particularly advantageous when the treatment gas is reactive.

After inserting the rod 14, the spring 22 which is not stressed, is in contact with the shoulder 21 and the inner shoulder 26. A nut 28 with a central hole with a diameter equal to approximately the diameter of the rod 14, and therefore less than the diameter of the shoulder 21, is screwed around the upstream end of the body 24 so as to prevent accidental extraction of the rod 14.

The connection element 16 is provided with a central channel in which the rod 14 can slide and a peripheral recess in which a duct 29 coming from the treatment gas reservoir can be inserted.

In the embodiment shown on the drawing, the nozzle 18 of the downstream part 17 is made more particularly from a metallic tube 30, firstly with a first end fixed in the downstream end of the connection element 16, and secondly a second end that clamps an approximately tubular metallic body 31.

This body 31 has a chamfered end that bears in contact with the upstream end, made in the form of a chamfered outer shoulder 33, a nozzle 34 made of a refractory material that also has a downstream end terminating in the end hole 19. This nozzle 34 is stabilised using a nut 35 screwed into the body 31 and with a central hole with diameter equal to approximately the diameter of the said nozzle 34. The second end of the nozzle 18 is finally inserted into a body 37 made of a refractory material that has a conical recess and that is fixed in the layer 11 of the sidewall 2 of the tank 1. At rest, the second end of the rod 14 is then fixed set back from the end hole 19 of the nozzle 34.

The injection device 8 is fixed in place using a support made from two metallic rods 38, 39 each of which has one end fixed to a notch in the metallic layer 9 of the sidewall 2 of the tank 1. A plate 40 comprising a central perforation and two peripheral perforations is slipped and then fixed along the two rods 38, 39. The injection device 8 is firstly slipped through the central perforation of the plate 40, and then fixed when it is correctly positioned.

The treatment gas used may consist equally well of an inert and insoluble gas such as argon, or a reactive gas such as chlorine, or a mix of these gases.

During operation, this treatment gas is inserted into the connection element 16 and is brought through the downstream part 17 of the injection device 8. It is finally ejected through the end hole 19 of the nozzle 34 into the treatment compartment 4 containing the molten metal.

When a manipulator wants to move impurities that have started to block the end hole 19 of the nozzle 34, he picks up the handle 20 and slides the rod 14. Under the effect of this translation, the second end of the rod 14 then passes through the end hole 19 and therefore perforates and/or pushes the residual deposits through, if any. When the manipulator releases the handle 20, the spring 22 relaxes between the shoulder 21 and the inner shoulder 26, and the rod 14 thus returns to its rest position.

Note that rod 14, instead of being manually controlled by the handle 20, may be activated by an automated control device (pneumatic, electromechanic or other), which avoids operator actions. One advantage then lies in the fact that this automated control device can be adjusted so that the different injection devices 8 are activated with a time shift.

A molten metal 41 may be treated using a process typically comprising:

- installation of a treatment tank 1 provided with at least one injection device 8 according to the invention,
- circulation of the molten metal 41 so as to form a determined flow of the said metal inside the tank,
- injection of a treatment gas using the injection device(s) 8,
- possibly, activation of means 14 to clear the end hole 19 of the nozzle 18, or each nozzle 18.

The operation to put the treatment tank into place in line typically includes the connection of the treatment tank to at least one molten metal supply duct 12 and at least one molten metal evacuation duct 13.

Although the invention has been described with relation to particular example embodiments, it is obvious that it is in no way limited and that it comprises all technical equivalents of the means described and combinations of them if they are covered by the scope of the invention.

LIST OF REFERENCE NUMERALS

1 Treatment tank
2 Tank sidewall
3 Tank bottom
4 Treatment compartment
5 Cover
6 Molten metal inlet means
7 Molten metal outlet means
8 Injection device
9 Outer layer
10 Refractory layer
11 Refractory layer
12 Supply duct
13 Evacuation duct
14 Rod

15 Upstream part of injection device
16 Connection element
17 Downstream part of injection device
18 Nozzle
19 End hole
20 Manual control device
21 Shoulder
22 Elastic element
24 Tubular body
25 Seal
26 Inner shoulder
27 Seal
28 Nut
29 Duct
30 Metallic tube
31 Metallic body
33 Outer shoulder
34 Nozzle
35 Nut
37 Refractory material body
38 Metallic rod
39 Metallic rod
40 Plate
41 Molten metal

The invention claimed is:

1. Device for injecting a treatment gas into a molten metal contained in a tank, the device being constructed and arranged to be fixed to a wall of the tank and comprising:

a tubular housing passing through the wall of the tank and extending from an upstream end external to the tank and attached to the wall of the tank, to a downstream end within the tank to which an injection nozzle is attached for injection of gas therein through an end hole, the upstream end of the tubular housing comprising a closure generally opposite to the injection nozzle and means for connection to a source of gas for injection, a rod which is disposed within the tubular housing and slidable therein, the rod having a diameter which decreases in steps from an upstream end disposed within the upstream end of the tubular housing to a downstream end disposed adjacent the nozzle, the upstream end of the rod having an outer diameter sufficiently close to an inner diameter of the upstream end of the tubular housing to provide a leaktight seal therebetween, and the downstream end of the rod having a diameter dimensioned for unblocking the end hole, and control means for linearly moving the rod through the tubular housing in a back and forth manner, comprising a rod extension from the upstream end through the closure by a predetermined length, and terminating in a control device, wherein the rod is linearly movable by the predetermined length from a first position in which the downstream end of the rod is adjacent the downstream end but set back from the end hole so as to enable passage of the treatment gas, to a second position in which the rod unblocks the end hole, the upstream ends of the rod and the tubular housing maintaining leaktightness throughout the back and forth movement.

2. Injection device according to claim 1, wherein, in the second position, the rod emerges beyond the end hole.

3. Injection device according to claim 1, additionally comprising an elastic element which holds the rod in the first position.

4. Injection device according to claim 1, additionally comprising an automated control device connected to the rod.

5. Injection device according to claim 1, wherein the nozzle comprises at least one rod guidance means.

6. Injection device according to claim 5, wherein the rod guidance means comprises a ring presenting a central hole and peripheral holes.

7. Injection device according to claim 1, additionally comprising elastic means which maintains the rod in the first position, wherein exertion of pressure on the control means moves the rod into the second position for unblocking the end hole.

8. Treatment tank for molten metal, comprising at least one gas injection device according to claim 1.

9. Injection device according to claim 1, additionally comprising a seal disposed between the upstream end of the rod and the upstream end of the tubular housing.

10. Injection device according to claim 9, wherein the tubular housing has an internal diameter which decreases in at least one step from the upstream end to the downstream end, and the rod comprises a second seal which seals the rod against the at least one step upon movement of the rod.

11. Injection device according to claim 1 wherein the control device is a handle means.

12. Injection device according to claim 1 wherein the control device is an automated device.

* * * * *